US010140839B1

(12) United States Patent
Smith et al.

(10) Patent No.: US 10,140,839 B1
(45) Date of Patent: Nov. 27, 2018

(54) ALARM SYSTEM COMMUNICATOR FOR FORWARDING ALARM SYSTEM EVENT DATA

(71) Applicant: Tyco Safety Products Canada Ltd., Concord (CA)

(72) Inventors: Derek C. Smith, Maple (CA); Dwayne Richard Salsman, Alliston (CA); Trevor E. Green, Toronto (CA)

(73) Assignee: TYCO SAFETY PRODUCTS CANADA LTD., Concord (CA)

( * ) Notice: Subject to any disclaimer, the term of this patent is extended or adjusted under 35 U.S.C. 154(b) by 0 days.

(21) Appl. No.: 15/918,671

(22) Filed: Mar. 12, 2018

(51) Int. Cl.
*G08B 25/00* (2006.01)

(52) U.S. Cl.
CPC ..... *G08B 25/001* (2013.01)

(58) Field of Classification Search
CPC ..... D06B 3/10; D06B 2700/27
USPC ..... 340/506
See application file for complete search history.

(56) References Cited

U.S. PATENT DOCUMENTS 4,511,886 A * 4/1985 Rodriguez ..... G08B 13/19645 340/506
2009/0189981 A1* 7/2009 Siann ..... H04N 7/183 348/143
2010/0063438 A1* 3/2010 Bengtsson ..... A61M 5/14248 604/66
2012/0313791 A1* 12/2012 Mehta ..... G01N 21/17 340/870.01
2016/0133120 A1* 5/2016 Reibel ..... G08B 25/008 340/506

* cited by examiner

*Primary Examiner* — Ojiako K Nwugo

(57) ABSTRACT

An alarm system communicator monitors alarm event data output from an alarm panel to a communications path, irrespective of whether the alarm system communicator is in an active or a passive mode. The alarm event data is forwarded to a remote central monitoring station (CMS) over another communications path while the alarm system communicator is operable in the active mode, and not forwarding the alarm event data to the CMS while operable in a passive mode. At least a portion of the alarm event data is forwarded to a secondary monitoring station (SMS), at least while the CMS communications module is in the passive mode. Further, there may be forwarding of at least a portion of the alarm event data to the SMS, irrespective of whether the alarm system communicator is in the active mode or the passive mode.

21 Claims, 6 Drawing Sheets

FIG. 10

1000

| | 1001 | 1002 | 1003 | 1004 | 1005 | 1006 | 1007 | 1008 |
|---|---|---|---|---|---|---|---|---|
| 1051 | Subscriber LName | Subscriber Fname | Subscriber address | Subscriber Cellular | Subscriber Password | Alarm Point | Report? | ••• |
| 1052 | ••• | ••• | ••• | ••• | ••• | ••• | | ••• |
| 1053 | Doe | Jane | 123 Main St., Anywhere, USA | (555) 555-1234 | redsox#1! | Apt Main Door | Y | ••• |
| 1054 | Doe | John | 234 Main St., Anywhere, USA | (555) 555-2345 | cinnam0n | Kit Motion | N | ••• |
| 1055 | | | | | | Front Door | Y | ••• |
| 1056 | | | | | | Rear Door | Y | ••• |
| 1057 | | | | | | Garage Door | N | ••• |
| 1058 | | | | | | Child1 Codein | Y | ••• |
| 1059 | | | | | | Child2 Codein | N | ••• |
| 1060 | | | | | | Child1 Cell Det | Y | ••• |
| 1061 | | | | | | Child2 Cell Det | N | ••• |
| 1062 | | | | | | Business Fdoor | Y | ••• |
| 1063 | ••• | ••• | ••• | ••• | ••• | ••• | | ••• |

ALARM SYSTEM COMMUNICATOR FOR FORWARDING ALARM SYSTEM EVENT DATA

FIELD OF THE DISCLOSURE

The disclosure relates generally to the field of alarm systems, and more particularly to alarm system communicator arrangements (methods, apparatus, etc.) for forwarding alarm system event data to a (e.g., secondary) reporting server or service to facilitate non-safety-type alarm notifications

BACKGROUND OF THE DISCLOSURE

Alarm systems, such as fire alarm and security systems, typically include one or more alarm panels that receive information from various sensors and that control various appliances distributed through a structured (or monitored) area. For example, a fire alarm system may include a plurality of initiating devices (e.g., smoke detectors, manually-actuated pull stations, contact switches, motion detectors, etc.) as well as notification appliances (e.g., strobes, sirens, public announcement systems, etc.) operably connected to one or more alarm panels.

During operation of the alarm system, the alarm panel may monitor electrical signals associated with the initiating (e.g., "point") devices for variations that may represent the occurrence of an alarm condition. For example, a variation in a particular electrical signal may represent the detection of smoke by a smoke detector in a corresponding area, or "zone," of a structure in which the smoke detector is located, and may cause the alarm panel to enter an alarm mode. The alarm panel may be configured to respond to such a condition by initiating certain predefined actions, such as activating one or more of the notification appliances within the monitored structure.

The alarm panel may also be configured to forward alarm data to a central monitoring station (CMS) of an alarm monitoring company or service. Data outputted by the alarm panel toward the central monitoring station 20 may include both safety-type alarm data (e.g., concerning fire, smoke, intrusion, chemical, biohazard, panic and medical incidents; alarm on activated; alarm on deactivated) and non-safety-type alarm data (e.g., door/window opened/closed; motion-detected; motion video captured; keypad code entry; key fob detected entering monitored area; key fob detected leaving monitored area; cell phone detected entering monitored area; cell phone detected leaving monitored area). The central monitoring station may be contracted to provide safety-type alarm monitoring and reporting to its contracting subscribers, and thus the central monitoring station may be interested only in a limited subset of the data. For example, the central monitoring station may process and report only the safety-type alarm data, while ignoring or discarding the remaining (e.g., the non-safety-type alarm) data.

However, it is believed that typical alarm monitoring subscribers may be interested in further receiving reporting of non-safety-type alarm events, in addition to reporting of safety-type alarm events. That is, so as long as a cost for doing so is reasonably priced to the subscribers. Further, while the subscribers may be disinterested in receiving reporting of each-and-every non-safety-type alarm event (given that a tremendous number of non-safety-type alarm events may occur in a given day), it is believed that subscribers may instead be interested in an arrangement in which reporting of specific types of non-safety-type alarm events is selectable by the subscriber.

For example, a subscriber may be disinterested in receiving reporting of every door, window, motion detector alarm event, but may be interested in receiving reporting of certain door, window and motion detector alarm events. As one example, assume the existence of a secluded unused basement in a residential home, and assume that the homeowner is at home and the alarm system is presently unarmed. Further, assume that both safety-type alarm events and non-safety-type alarm events are communicable events which are communicated from the alarm panel to the central monitoring station. While a basement door, window or motion detector alarm event might be considered a safety-type alarm event during times when the alarm system is armed, events related to the basement door, window or motion detector might be considered a non-safety-type alarm event and ignored by the central monitoring station during times when the alarm system is unarmed. That is, if an intruder triggered a basement door alarm point by entering the basement and further triggered the motion detector, the basement door opening and basement motion detector events would not be reported by the central monitoring station because such events are not considered safety-type events while the system is unarmed. However, the homeowner may desire that all basement door, window or motion detector alarm events get reported to the homeowner, irrespective of whether the alarm system is armed or disarmed. That is, the homeowner probably would like the ability to select that the basement non-safety-type events also get reported to him/her.

SUMMARY

In view of the forgoing, disclosed are arrangements (methods, apparatus, etc.) which provide the ability to achieve reporting of non-safety-type alarm events to subscribers, and at a reasonable cost. Further, such arrangements can include the ability for a subscriber to easily selectively pick and choose which of the non-safety-type alarm events gets reported to the subscriber.

An alarm system communicator having a central monitoring station (CMS) communications module is also included which forwards the alarm event data monitored from a communications path, to a remote CMS over another communications path while the alarm system communicator is operable in an active mode, and not to forward the alarm event data to the CMS while operable in a passive mode. A secondary monitoring station (SMS) communications module is used to forward at least a portion of the alarm event data to a SMS, at least while the CMS communications module is in the passive mode.

BRIEF DESCRIPTION OF THE DRAWINGS

By way of example, specific embodiments of the disclosed device will now be described, with reference to the accompanying drawings, in which:

FIG. 10 illustrates a portion of an example database containing example data for subscribers, in accordance with the present disclosure.

DETAILED DESCRIPTION

Figure 1:
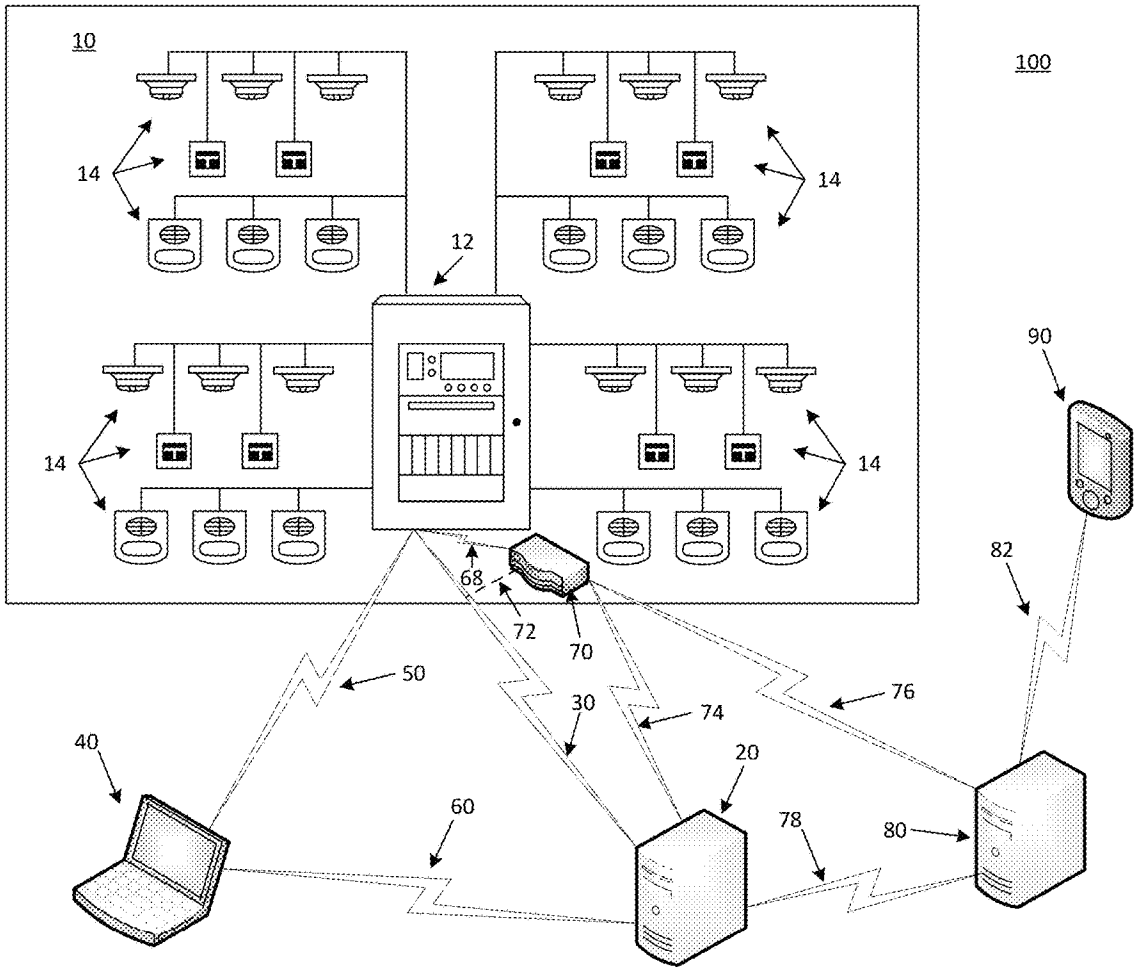
FIG. 1 is a block diagram illustrating an example alarm system including arrangements to achieve reporting of non-safety-type alarm events to subscribers, in accordance with the present disclosure.

As discussed above, various inabilities have existed in being able to receive reporting of non-safety-type alarm events of an alarm system. To this end, arrangements enabling reporting of non-safety-type alarm events in an alarm system in accordance with the present disclosure will now be described more fully hereinafter with reference to the accompanying drawings. In some examples, an alarm system communicator is arranged to forward data of non-safety-type alarm events to a reporting server, thereby enabling the ability of reporting the non-safety-type alarm events. With some examples, existing (e.g., prior generation; legacy) alarm system communicators are repurposed (e.g., via upgraded programming) to utilize previously unused data monitoring/transmitting capacities, so that the non-safety-type alarm event reporting may be enabled at low cost.

Furthermore, these disclosed arrangements may be embodied in many different forms and are not to be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the non-safety-type alarm event reporting arrangements described herein may be implemented for virtually any type of alarm, monitoring, or control system, including, but not limited to, fire alarm systems, burglar alarm systems, surveillance systems, air quality monitoring systems, inventory monitoring systems, etc., or any combination thereof, such as may be provided for detecting an alarm event (e.g., a security breach) or a warning condition (e.g., an elevated temperature) in a building, structure, enclosure, or area (collectively referred to herein as "sites"). Many other applications are contemplated and may be implemented without departing from the scope of the present disclosure. All such applications are collectively referred to herein as "alarm systems."

A first exemplary alarm system in accordance with the present disclosure is depicted in FIG. 1. The disclosed system 100 may include an alarm system 10 installed at a monitored site (represented by FIG. 1 rectangle). The alarm system 10 may include an alarm panel 12 operably connected to a number of points 14 (e.g., initiating devices and/or notification appliances). Furthermore, the alarm system 10 may be communicatively coupled to a central monitoring station (CMS) 20 via connection 30. In general, the central monitoring station 20 may be a server at a location remote from the monitored site. It is to be appreciated that the central monitoring station 20 may be a single computing device or may be multiple computing devices. For convenience of discussions within this disclosure, however, the central monitoring station 20 is referred to as a single device.

During operation of the alarm system 10, various maintenance needs (e.g., updating) may arise. The central monitoring station 20 may be configured to determine what maintenance operations to perform to reduce the number of times the alarm system 10 requires maintenance.

Additionally, the central monitoring station 20 may be configured to validate the installation (or configuration) of the alarm system 10 to reduce the probability of future maintenance needs of the system. As may be appreciated, during installation of the alarm system 10, a technician may place the points 14 throughout the site to be monitored by the alarm system 10. Furthermore, the technician may configure the alarm panel 12 to recognize the points 14. This may include organizing the points 14 into different zones, configuring the behavior of the alarm panel 12 in response to signals received from the points 14, and configuring a connection 30 between the alarm panel 12 and the central monitoring station 20.

In order to aid in the installation or in later maintenance, the technician may utilize a computing device 40. The computing device 40 may be a portable computing device (e.g., a laptop computer, a tablet computer, a smart phone, or the like) that may be communicatively coupled to the alarm panel 12 via connection 50 and to the central monitoring station 20 via connection 60. The technician may use the computing device 20 to configure the alarm panel 12 during an initial installation and to update the configuration of the alarm panel 12 (e.g., at a maintenance visit, or the like).

In general, the connections (or paths) 30, 50, and 60 may be any type of data communication connection configured to allow signals to be transmitted between ones of the alarm panel 12, the central monitoring station 20, and the computing device 40. It is noted that although the connections 30, 50, and 60 are depicted in FIG. 1 as wireless connections, the connections may be wireless or may be wired. Furthermore, with some examples, the connections 30, 50, and/or 60 may be routed through a network (e.g., a TCP/IP network, a cellular network, a packet switched network, the Internet, or the like). Additionally, the connections 30, 50, and 60 may not be the same type of connection. For example, the connection 30 may be a cellular telephone connection, the connection 50 may be a universal serial bus connection, and the connection 60 may be a connection routed through the Internet. Still further, the connections 30, 50 and 60 may each vary in type along a connection path thereof. For example, a connection may be partly routed through the Internet, partly routed through a cellular network, etc.

The disclosed system 100 may further include a communicator 70 installed as part of the alarm system 10 at the monitored site. The communicator 70 may contain cellular or some other type of communication capability, and may be provided as a separate apparatus installed: within the alarm panel 12; adjacent to the alarm panel 12; or somewhere within the monitored site. For example, the communicator 70 may be installed within the alarm panel 12 or adjacent to the alarm panel 12, if acceptable cellular reception is available at such installation locations. As another example, the communicator 70 may be installed elsewhere in the monitored site (i.e., remote from the alarm panel 12 to achieve better cellular reception, better accessibility, etc.

Such communicator 70 may be a universal (i.e., generic) communicator which is capable of working properly with many differing types of alarm systems and/or alarm panels 12. Alternatively, the communicator 12 may be proprietary in construction, and designed to work with a particular brand/model of alarm system and/or alarm panel 12.

One purpose of the communicator 70 may be to monitor (see FIG. 1 dashed line 72) for failures in communications between the alarm panel 12 and the central monitoring station 20 along the connection 30. In a simplistic mode of operation without the knowledge of this disclosure, the communicator device 70 might mainly remain passive and simply monitor the connection 30. That is, while the communicator might be capable of both monitoring (e.g., reading, accessing) data present on the connection and outputting such data via the connection 74, the communication was (before the teachings of this disclosure) configured to do nothing with the data unless/until a connection 30 failure occurred.

That is, as long as the connection between the alarm panel 12 and the central monitoring station 20 was viable (i.e., working properly), the communicator device 70 would do nothing with any data available from the connection 30. Such operation could be phrased as the communicator 70 operating in a passive mode. In the event of a detected failure of the connection 30, the communicator 70 would then utilize (e.g., activate, establish) the communicative coupling connection 74 to provide an alternative (e.g., emergency; fail-over) communications path or channel between the alarm panel 12 and the central monitoring station 20, and then would access and route the data through the communicator 30 and connection 74, to the central monitoring station. In short, without the knowledge provided by this disclosure, the communicator 70 would only perform back-up or fail-over services.

As one non-exhaustive, non-limiting example of a connection 30 type, the connection 30 may be provided via a Plain Old Telephone Service (POTS) hardwire line or may be provided via the Internet, and failure thereof may result because of a physical line cut (e.g., by an intruder) or loss of Internet connection (e.g., by storm outages). In contrast, the connection 74 may be a cellular connection. That is, the connections 30 and 74 can be of differing types from one another such that a type of failure affecting connection 30 will not also affect connection 74. Such allows the alarm panel 12 to communicate with the central monitoring station 20, even upon failure of the primary connection 30.

Figure 9:
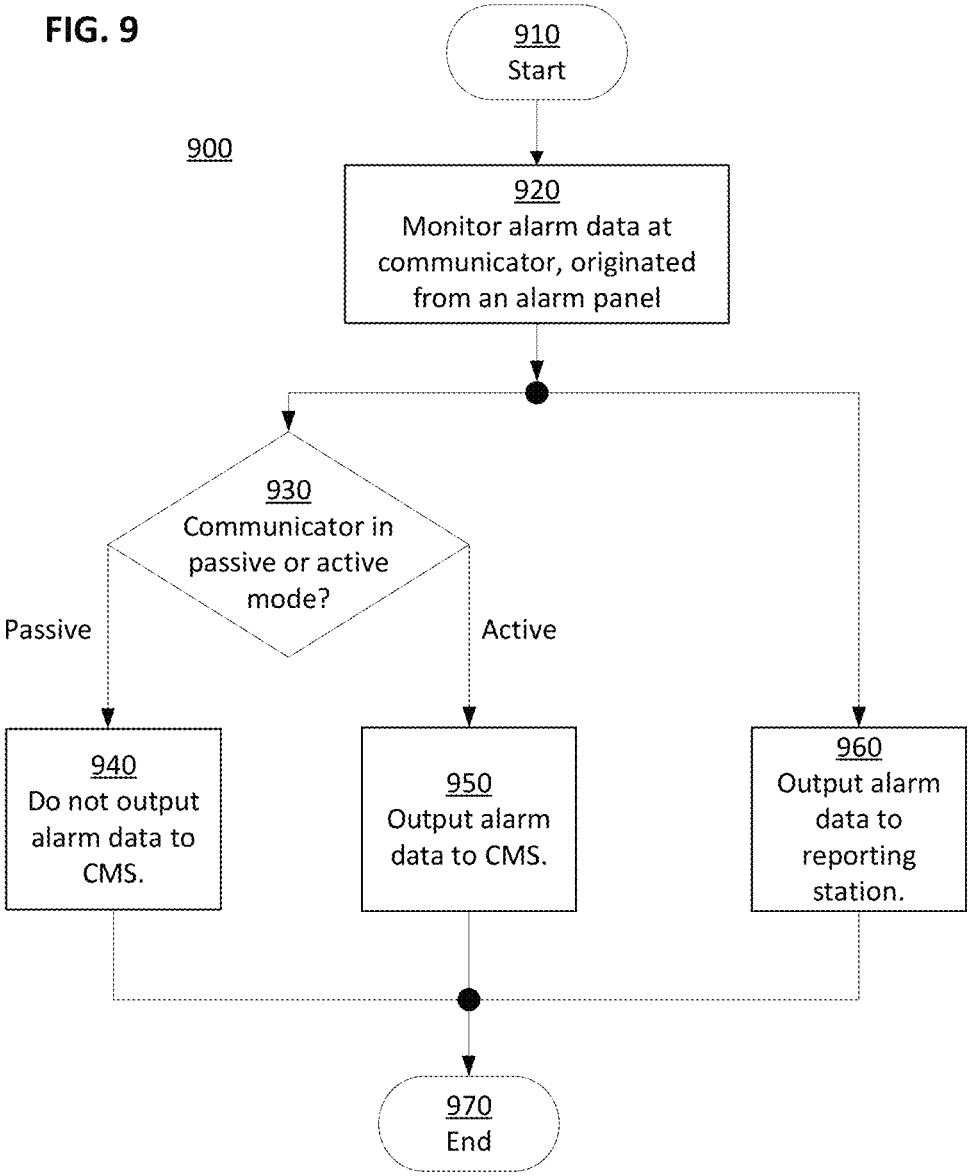

Next, a left-hand branched side of FIG. 9 illustrates an example flow 900 of the communicator operating in the passive and active modes. More particularly, after start (block 910), the communicator monitors (possibly receives) alarm data originated from the alarm panel (920). At decision 930 it is decided whether the communicator is operating via a passive mode or active mode. If passive, data is not outputted by the communicator to the CMS (block 940) via the connection 74. If active, data is outputted to the CMS (block 950). After block 940 or 950, flow operations end (block 970).

While the above example represents a combined mode where the communicator 30 partially operates in the passive mode and partially operates in the active mode, in some alarm system installations, the connection 30 may be non-existent, and may be purposefully taken over by connection 74 and with the communicator 70 only operating in the active mode. Thus, in the FIG. 9 flow, the passive branch including operation 940 would be decommissioned, and the active branch including operation 950 would dominate. As one situation where this might happen, consumers have trended toward eliminating residential POTS hardwire lines to save costs. In such situations where there is an absence of the connection 30, the connection 74 might be used as a primary connection between the alarm panel 12 and the central monitoring station 20.

The connection 30 may fail for many reasons, and sometimes failures may even result in data being unavailable along the failed connection 30. In such situations or in situations where the connection 30 is non-existent, the communicator 70 would not be able to obtain alarm panel data via the connection 30. Accordingly, a connection 68 (e.g., a wired USB connection) may be used to provide alternative (direct) communications between the alarm panel 12 and the communicator 70. Such connection 68 would serve to get data from the alarm panel 12 to the communicator 70 in view of no information being delivered from the alarm panel 12 to the communicator 70 via the connection 30. The connection 68 may also be used to send data (e.g., requests) upstream from the communicator 70 to the alarm panel 12.

Data outputted by the alarm panel 12 toward the central monitoring station 20 may include both safety-type alarm data (e.g., concerning fire, smoke, intrusion, chemical, biohazard, panic and medical incidents; alarm activation detected; alarm deactivation detected) and non-safety-type alarm data (e.g., door/window opened/closed; motion-detected; motion video captured; keypad code entry; key fob detected entering monitored area; key fob detected leaving monitored area; cell phone detected entering monitored area; cell phone detected leaving monitored area). In contrast, the central monitoring station (contracted to provide safety-type alarm monitoring and reporting) may be interested only in a limited subset of the data. For example, the central monitoring station 20 may process and report alarm events pertaining to only the safety-type alarm data, while ignoring or discarding the remaining (e.g., the non-safety-type) alarm data.

While this disclosure utilizes "safety-type" and "non-safety-type" nomenclature for convenience to describe alarm data, practice of arrangements of the invention is not limited by such nomenclature. As another example, the central monitoring station (CMS) may be configured to report only alarm events which are CMS-designated as reportable alarm events while being configured not to report a remainder of alarm events. CMS-designated may be those alarm events which are listed within a CMS service agreement materials or contract, or may be those alarm events which may require involvement of safety authorities such as the fire department, police department, etc. As another example, the central monitoring station may be configured to report only a range of alarm events (e.g., of predetermined importance) while being configured not to report a remainder of alarm events (e.g., lower importance). As one predetermined importance example, if dangerous pressures of a pressure tank are designated as pressures 500 PSI and above by a tank manufacturer, the CMS might be configured to report an alarm event of 500 PSI and above, while not reporting alarm events below 500 PSI.

Contrary to having a portion of alarm events unreportable, it is believed that there exists a desire by alarm system subscribers (hereinafter, "subscriber" or "subscribers") to also obtain reporting of other (e.g., non-safety-type) alarm events. As one example, a subscriber may want to know of the occurrence of lower pressures (e.g., 350-499 PSI) with the above-mentioned pressure tank example. As another example, a working parent (while still at their remote workplace) may want to receive a report that his/her school-aged child has arrived safely at home. Example data useful in a determination of child arrival/departure might be an alarm event indicating: door opened/closed; child's keypad code entered into alarm panel keypad; video captured; child's cell phone detected entering monitored site; etc. In view of the above, one goal of this disclosure is to provide arrangements which are capable of reporting alarm panel data beyond just safety-type alarm data/incidents. That is, allow the subscriber to also receive reporting regarding one or more non-safety-type alarm events.

The above goal, of course, could be accomplished via high cost with existing (e.g., prior generation; legacy) alarm systems, by replacing parts or a whole of alarm system hardware (e.g., alarm panel 12; sensors and appliances 14; communicator 70) with a newer generation hardware offering the desired capabilities. However, a subscriber with an existing alarm system which is otherwise working properly, may decline replacement with newer hardware owing to the significant costs and disruption involved with replacement. Accordingly, another goal is to provide the additional non-safety-type reporting capability with minimal changes/costs to subscriber's existing alarm systems.

The inventors have found that a low-cost goal is indeed accomplishable. More particularly, the inventors have recognized that the communicator 70 already had inherent capabilities (e.g., data accessing; data transmission) which were unused or idled most of the time, and which could be repurposed (e.g., via a firmware, software, etc., upgrade) to help provide the additional reporting capability. That is, existing communicators 70 could be re-programmed/re-purposed to serve double-duty functions of performing connection 30 monitoring and failover, while at the same time, additionally accessing/forwarding the alarm panel data to a secondary monitoring station (e.g., reporting server). The re-programming of the existing communicator 70 would represent little cost to the subscriber (e.g., a maintenance upgrade visit by a service technician), thus making it more likely that subscribers would subscribe to the new non-safety-type alarm reporting.

While a reporting server 80 (FIG. 1) may also be needed at a reporting company's (i.e., subscription-offering provider's) end, the initial cost outlay for the reporting server 80 could be fronted by the reporting company, not the subscribers. The reporting server would be able to process the data and provide reporting of non-safety-type events to a subscriber, as desired (e.g., via selection) by the subscriber. That is, in addition to subscribing to a central monitoring station 20 for receiving reporting of safety-type alarm events, the subscriber (e.g., residential home owner) may also subscribe to the secondary monitoring station for receiving reporting of non-safety-type alarm events.

As a further avenue to achieving low-cost, a subscriber's already-existing subscriber device 90 (FIG. 1) can serve as a receiver device for receiving reporting of non-safety-type alarm events. Example subscriber devices 90 may be cell phones, smart phones, personal digital assistants (PDA's), tablets, notebooks, desktops, smart TVs, smart appliances, etc. If the subscriber device 90 is mobile such as cell phones, smart phones, personal digital assistants (PDA's), tablets, notebooks, then the mobile subscriber device 90 may be advantageously carried by the subscriber wherever he/she might go. Thus, the non-safety-type alarm reporting would advantageously be available to the subscriber wherever he/she might be. For example, the subscriber could receive reporting while at home, while at the office, while on vacation, etc. As one example, a subscriber parent located within his/her bedroom at home, may receive a non-safety-type event notification on his/her cell phone, that his/her son's/daughter's cell phone had just exited a range of the monitored area.

Already-existing subscriber devices 90 may be easily outfitted with additional programming (e.g., via downloading/installation of an app) to allow the subscriber devices to receive non-safety-type alarm events from the reporting server 80. The re-programming of the existing subscriber devices 90 would represent little cost (e.g., an app download) to the subscriber, thus making it more likely that subscribers would subscribe to the new non-safety-type alarm reporting.

In continuing and returning to FIG. 1, the communicator 70 may be communicatively coupled to a secondary monitoring station (e.g., reporting server) 80 via connection 76, and may also be communicatively coupled to the central monitoring station 20 via connection 74. In general, the reporting server 80 may be a server at a location remote from both the monitored site and the central monitoring station 20. Alternatively, the reporting server 80 may be provided together (i.e., integrated) with the central monitoring station 20. For example, a safety alarm monitoring company's server 20 might be configured to also offer the (e.g., subscription) service of reporting of non-safety-type alarm events in addition to reporting safety-type alarm events. As another configuration example, it is to be appreciated that the reporting server 80 may be a single computing device or may be multiple computing devices. For convenience of discussions within this disclosure, the reporting server 80 is referred to as a single device and separate from the central monitoring station 20.

Further shown in FIG. 1, the reporting server 80 may also be communicatively coupled to the central monitoring station 20 via connection 78. Such connection allows the direct exchange of data therebetween. For example, a points list or other system configuration data may be forwarded from the central monitoring station 20 to the reporting server 80. The remote server 80 may need such information when setting up a new account for a subscriber (an example will be described later). As another example, the central monitoring station 20 may be configured to send a copy of reported safety-type (e.g., break-in, fire, medical) notifications to the reporting server 80, in addition to reporting the safety-type notifications to the subscriber.

Further shown in FIG. 1 is the reporting server 80 communicatively coupled to the subscriber device 90 via connection 82. Operation of the reporting server 80 together with the subscriber device 90 will be described later. Further, while the subscriber device 90 has been described in some examples above as via a single subscriber device 90, practice is not limited to a single subscriber device 90. As another example, the subscriber parent may receive the non-safety type event notification on multiple devices (e.g., his/her cell phone, and his/her desktop or laptop). Further, as another example, both parents may be designated to receive the non-safety-type event notification on their own subscriber devices. That is, in one embodiment, one or more primary subscriber may be able to designate which types of non-safety-type event notifications to report, and also designate which subscriber device or devices are to receive each type of non-safety-type event notification.

In continuing further discussion of FIG. 9, a right-hand side thereof illustrates a further portion of the example flow 900 of the communicator operating to output the alarm data (e.g., both the safety-type and non-safety-type) to the reporting station 80. More particularly, after the start 910, the communicator 70 receives alarm data originated from the alarm panel (920) and forwards such data onto the reporting station 80. The communicator 70 forwards the data irrespective of whether the communicator 70 is in a passive mode or an active mode. Accordingly, inherent capabilities (e.g., data accessing; data transmission) of the communicator 70 which were unused or idled most of the time (i.e., before this disclosure), are now used to achieve forwarding (and ultimate reporting) of non-safety-type alarm events. Again, such unused capabilities could be repurposed (e.g., via a firmware, software, etc., upgrade) to help provide the additional reporting capability. Again, the re-programming of the existing communicator 70 would represent little cost to the subscriber (e.g., a maintenance upgrade visit by a service technician), thus making it more likely that subscribers would subscribe to the new non-safety-type alarm reporting.

In general, the connections 68, 74, 76, 78 and 82 may be any type of data communication connection configured to allow signals to be transmitted between ones of the alarm panel 12, the central monitoring station 20, the communicator 70, the reporting server 80 and/or the subscriber device 90. It is noted that although the connections 68, 74, 76, 78 and 82 are depicted as FIG. 1 wireless connections, the connections may be wireless or may be wired. As examples, the connections 68, 74, 76, 78 and/or 82 may be routed through a network (e.g., a TCP/IP network, a cellular network, a packet switched network, the Internet, or the like). Additionally, the connections 68, 74, 76, 78 and 82 may not be the same type of connection. For example, the connections 74 and 82 may be cellular telephone connections, the connection 68 may be a universal serial bus (USB) connection, and the connections 76 and 78 may be connections routed through the Internet. Still further, the connections 68, 74, 76, 78 and 82 may each vary in type along a connection path thereof. For example, a connection may be partly routed through the Internet, and partly routed through a cellular network.

Example constructions of the alarm panel 12, the central monitoring station 20, the computing device 40, the communicator 70, the reporting server 80 and the subscriber device 90, will now be described more fully with reference to FIGS. 2-7. Example operations and example methods for providing reporting of non-safety-type events of an alarm system will then be described with reference to FIG. 8.

Figure 2:
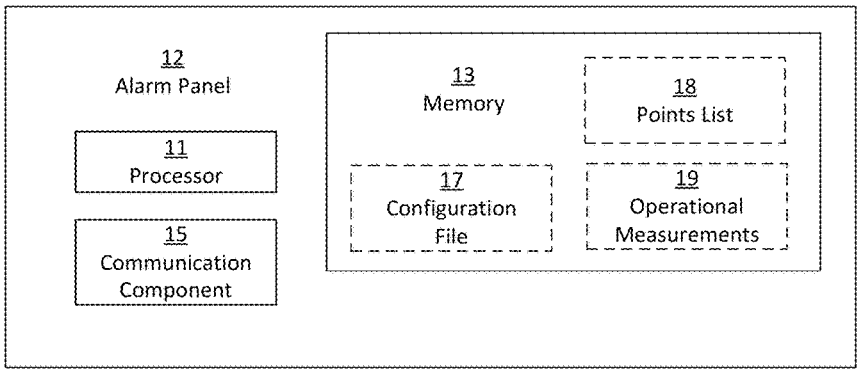
FIGS. 2-7 are block diagrams illustrating example portions of the system shown in FIG. 1 is greater detail.

Turning now to FIG. 2, the alarm panel 12 may include a processor 11, a memory 13, and a communication component 15. The processor 11 can be any microprocessor configured to execute a set of instructions, which when executed, cause the alarm panel 12 to perform a set of actions defined by the instructions. The memory 13 may be any type of computer-readable medium, including non-transient computer-readable medium, such as, for example, EPROM, EEPROM, ROM, FLASH, magnetic storage media, or the like. The communication component 15 may be any device and/or module configured to establish communication with the central monitoring station 20, the computing device 40 and/or the communicator 70. The communication component 15 may be configured to establish a wireless or a wired communication link 30 with the central monitoring station 20 for purposes of transmitting data (e.g., operational measurements) from the alarm panel 12 to the central monitoring station 20. Additionally, the communication component 15 may be configured to establish a wireless or a wired communication link 50 with the computing device 40 for purposes of configuring and/or performing maintenance on the alarm system 10. Finally, the communication component may be configured to establish a wireless or a wired communication link 68 with the communicator 70 for purposes of communicating data between the communicator 70 and the alarm panel 12.

In some examples, the communication component 15 may be a network interface component (e.g., an Ethernet port, a WIFI radio, a Cellular data radio, or the like). In some examples, the connection component 15 may be a packet switched network component (e.g., a telephone modem, a DSL modem, or the like). Such are non-limiting, non-exhaustive examples. Further, the communication component may have plural ports and differing ones of the plural ports may be differing types of ports. For example, there may be two ports, with a first port being an Ethernet port, and a second port being a cellular port. Having plural differing types of ports enables the communication component to facilitate communications with plural apparatus having differing communication capability types, and makes the communications component more versatile.

The memory 13 of the alarm panel 12 may store a configuration file 17 which may be used by the alarm panel 12 during operation. In general, the configuration file 17 indicates the points 14 that are connected to the alarm panel, their type, their status (e.g., active, inactive, or the like), their function, alarm conditions, actions to take if alarm conditions are detected, etc. The configuration file 17 is encoded into a format readable by the alarm panel 12, and is therefore not necessarily human-readable. The format may differ depending upon the type of alarm panel, the manufacturer of the alarm panel, the model of the alarm panel, etc. The memory 13 may also store a points file 18. The points list 18 may include a listing of the points 14 installed in the alarm system 10, and include data related to each point 14. In some examples, the points list 18 may include a model identification corresponding to the points 14 represented in the points list 18.

During operation of the alarm system 10, the alarm panel 12 records various quantitative measurements and stores them in the memory 13 as operational measurements 19. As an example, the operational measurements 19 may include measurements of the battery level of one or more points 14. As another example, the operational measurements 19 may include measurements of the wireless connectivity level of one or more of the points 14. As another example, the operational alert may include a measurement of the cellular connectivity level of the alarm panel 12. As another example, the operational measurements 19 may include a measurement of the resistance of connections between various points 14. As another example, the operational measurements 19 may include a measurement of the power consumption of the alarm pane 12. As other examples, the operational measurements 19 may include measures of temperature, vibration, humidity, carbon monoxide, smoke compensation, or the like. As will be appreciated, it is not feasible to exhaustively list all of the potential embodiments of the operational measurements 19. The above examples, however, are provided for clarity of presentation, but are not intended to be limiting or exhaustive.

The alarm panel 12 may communicate the operational measurements 19 (e.g., in real time, periodically, in groups, or the like) to the central monitoring station 20 for purposes of keeping the central monitoring station informed regarding a status of, and instances occurring on, the alarm system 10. A brief non-limiting, non-exhaustive example is provided here for clarity. The system 10 may be configured to monitor pressure in, for example, a tire, a vessel, a tank, a storage container, or the like. During operation, the panel 12 may record various quantitate measurements of the pressure inside the monitored vessel. Such measurements may be periodically transmitted to the central monitoring station 20. The central monitoring station 20 may use the operational measurement to "predict" future pressure conditions. For example, if the pressure is continually declining, the central station 20 may determine that a leak exists even if the pressure has not fallen below a critical level, and institute some type of alarm procedure.

Figure 3:
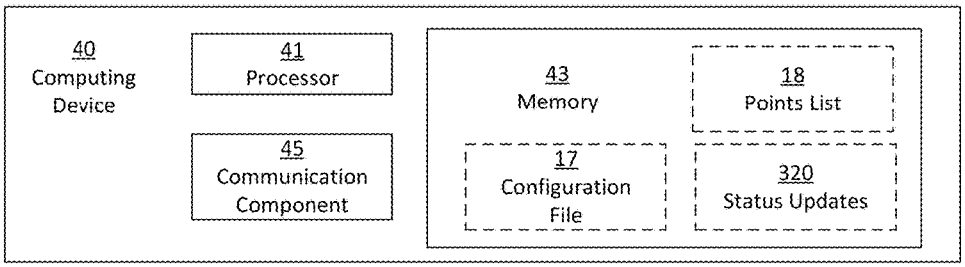

Turning now to FIG. 3, the computing device 40 may include a processor 41, a memory 43, and a communication (e.g., connection) component 45. The processor 41 can be any microprocessor configured to execute a set of instructions, which when executed, cause the computing device 40 to perform a set of actions defined by the instructions. The memory 43 may be any type of computer-readable medium, including non-transient computer-readable medium, such as, for example, EPROM, EEPROM, ROM, FLASH, magnetic storage media, or the like.

The communication component 45 may be any device and/or module configured to establish communication with the alarm panel 12 and/or the central monitoring station 20. In general, the communication component 45 may be configured to establish a wireless or a wired communication link with the alarm panel 12 for purposes of configuring the alarm panel, updating the configuration of the alarm panel, or performing maintenance on the alarm panel. Additionally, the communication component 45 may be configured to establish a wireless or a wired communication link with the central monitoring station 20 for purposes of transmitting data (e.g., points, status updates, or the like) from the computing device 40 to the central monitoring station 20.

In some examples, the communication component 45 may be a network interface component (e.g., an Ethernet port, a WIFI radio, a Cellular radio, or the like). Further, the communication component 45 may have plural ports and differing ones of the plural ports may be differing types of ports. For example, there may be two ports, with a first port being an Ethernet port, and a second port being a cellular port. Having plural differing types of ports enables the communication component to facilitate communications with plural apparatus having differing communication capability types, and makes the communication component more versatile.

The memory 43 of the computing device 40 may store points list 18, status updates 320, and/or configuration file 17. The points list 18 may be a copy of the points list stored in the alarm panel 12. The status updates 320 may include various characteristics of the points 14 represented in the points list 18. In general, the status updates may include any quantitative data regarding the measurements from a device in the system, as well as the detailed information (e.g., the firmware, software, hardware, or the like) about the device. Additionally, the status updates 320 may include status updates corresponding to the points 14 or updated coding (e.g., firmware, software) for controlling an operation of the alarm system (e.g., alarm panel 12). For example, the status updates 320 may include measurements of the battery level of one or more points 14. As another example, the status updates 320 may include measurements of the wireless connectivity level of one or more of the points 14. As another example, the status updates 320 may include a measurement of the cellular connectivity level of the alarm panel 12. As another example, the status updates 320 may include a measurement of the resistance of connections between various points 14. As another example, the status updates 320 may include a measurement of the power consumption of the alarm panel 12.

The points list 18 and the status updates 320 may be communicated to the central monitoring station 20 during an initial installation, configuration, or maintenance operation of the alarm system 10 for purposes of the central monitoring station 20 determining maintenance needs, validating installation and/or updating of the alarm sy stem 10.

Figure 4:
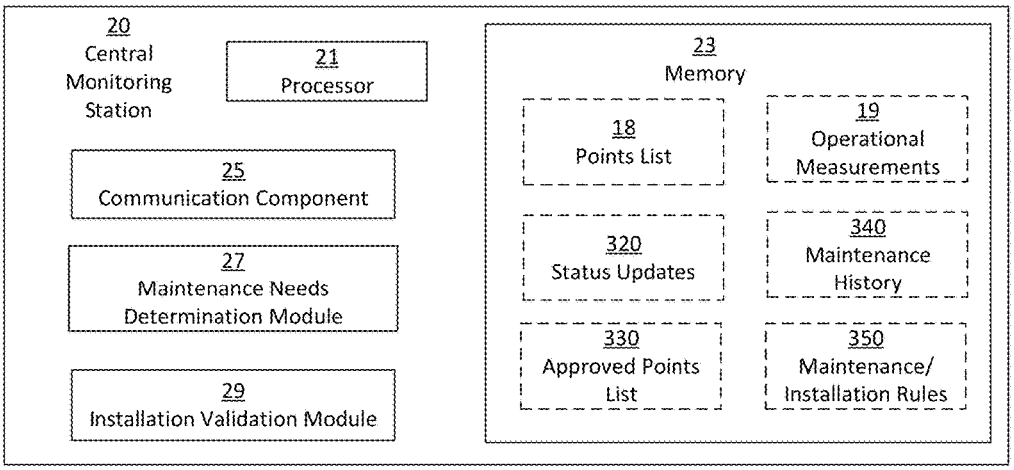

Turning now to FIG. 4, the central monitoring station 20 may include a processor 21, a memory 23, a communication component 25, a maintenance needs determination module 27, and an installation validation module 29. The processor 21 can be any microprocessor configured to execute a set of instructions, which when executed, cause the central monitoring station 20 to perform a set of actions defined by the instructions. Furthermore, the memory 23 may be any type of computer-readable medium, including non-transient computer-readable medium, such as, for example, EPROM, EEPROM, ROM, FLASH, magnetic storage media, or the like.

The communication component 25 enables the central monitoring station 20 to connect to the alarm panel 12 (e.g., via connection 30) and to the computing device 40 (e.g., via the connection 50) for purposes of determining maintenance needs, validating installation and/or updating of the alarm system 10. The communication component 25 may enable the central monitoring station 20 to connect to the reporting station 80 for purposes of transmitting data (e.g., points list 18, status updates, event data or the like) from the central monitoring station 20 to the reporting station 80, and for receiving requests from the reporting station 80.

In some examples, the communication component may be an Ethernet port, or the like, thus enabling the central monitoring station 20 to be accessible via the Internet. In other non-exhaustive, non-limiting examples, the communication component may be universal serial bus (USB), wireless and/or cellular communication ports. Further, the communication component may have plural ports and differing ones of the plural ports may be differing types of ports. For example, there may be two ports, with a first port being an Ethernet port, and a second port being a cellular port. Having plural differing types of ports enables the communication component to facilitate communications with plural apparatus having differing communication capability types, and makes the communication component more versatile.

The memory 23 of the central monitoring station 20 may store the points list 18, the operational measurements 19, and the status updates 320. As described above, these may be received from the alarm panel 12 and/or the computing device 40 during operation of the alarm system 10 and/or during installation, configuration, maintenance and/or updating of the alarm system 10. Additionally, the memory 23 may store an approved points list 330, a maintenance history 340, and maintenance and installation rules 350.

The approved points list 330 may include a listing of commercially-available points 14 that are approved. More particularly, the approved points list 330 may include a listing of points (e.g., type, manufacturer, model number, or the like) that are approved for installation in the alarm system 10. With some examples, a monitoring company responsible for maintenance of the alarm system 10 may provide the approved points list. As another example, the approved points list may correspond to points preferred by alarm system monitoring agencies. Some alarm systems are installed and subsequently one or more contracts to monitor, service, and/or maintain the alarm system are sold. As such, the approved points list may be provided to ensure that the alarm system 10 is installed according to desired standards.

The maintenance history 340 may include maintenance operations performed thus far on the alarm system 10. In some examples, the maintenance history 340 may include a listing of the maintenance operations performed on the alarm system 10 and the corresponding dates at which the maintenance operations were performed. Additionally, the maintenance history 340 may include information from the operational measurements 19. More specifically, the maintenance history 340 may be a historical database including information related to the overall operation (e.g., maintenance, performance, or the like) of the alarm system 10. The maintenance history 340 may be provided to determine maintenance needs of the alarm system 10.

The maintenance and installation rules 350 may include a variety of rules related to making determinations about maintenance needs and installation of the alarm system 10. It is to be appreciated, that a variety of rule based decision making techniques may be employed, and as such, the maintenance and installation rules 350 may be embodied in a variety of different rule types (e.g., decision tree, many-valued logic, fuzzy logic, or the like). The maintenance and installation rules 350 may be provided to determine the maintenance needs and validate the installation of the alarm system 10.

In general, the maintenance needs operation module 27 may determine a maintenance need of the alarm system based at least in part on the plurality of operational measurements 19 and the maintenance history 340, and the maintenance and installation rules 350. For example, the maintenance needs determination module 27 may apply the maintenance and installation rules 350 to the maintenance history 340 and the operational measurements 19 to determine one or more maintenance operations.

With some examples, the maintenance needs determination module 27 may determine required (e.g., necessary for continued operation, or the like) maintenance needs of the alarm system 10 as well as one or more suggested (e.g., optional for improved performance, or the like) maintenance needs of the alarm system 10. For example, the maintenance needs and determination module 27 may determine (e.g., based on model identifications of the points list 18, or the like) that various ones of the points 14 may be upgraded (e.g., newer, different manufacturer, different model, or the like).

In general, the installation validation module 29 may validate the installation of the alarm system 10 based at least in part on the points list 18, the status updates 320, the approved points list 330, and the maintenance and installation rules 350. For example, the installation validation module 29 may apply the maintenance and installation rules 350 to the points list, the status updates 320, and the approved points list 330 to determine whether the alarm system 10 is installed to a specified standard. With some examples, the installation validation module 29 may generate (e.g., display, print, email, or the like) a pass/fail report listing the criteria used to determine whether the installation of the alarm system 10 is validated.

Figure 5:
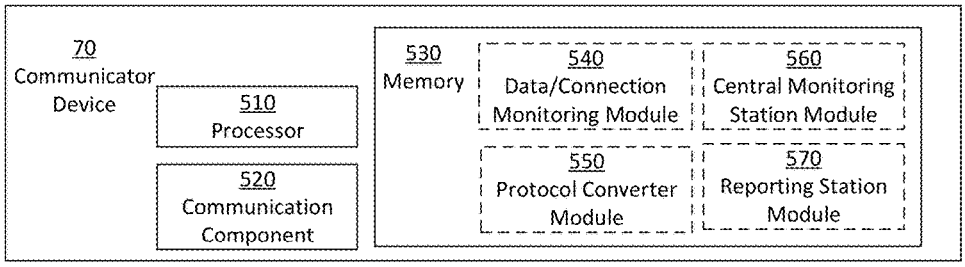

Referring now to FIG. 5, the communicator device 70 may include a processor 510, a communication (e.g., connection) component 520 and a memory 530. The processor 510 can be any microprocessor configured to execute a set of instructions, which when executed, cause the communicator device 70 to perform a set of actions defined by the instructions. The memory 530 may be any type of computer-readable medium, including non-transient computer-readable medium, such as, for example, EPROM, EEPROM, ROM, FLASH, magnetic storage media, or the like.

The communication component 520 may be any device and/or module configured to establish communications with the alarm panel 12, the central monitoring station 20, and/or the reporting station 80. In general, the communication component 520 may be configured to establish a wireless or a wired communication link 68 with the alarm panel 12 for purposes of receiving data output by the alarm panel and/or sending requests to the alarm panel 12. Additionally, the communication component 520 may be configured to establish a wireless or a wired communication link with the central monitoring station 20 for purposes of transmitting data (e.g., points list 18, alarm data, or the like) from the alarm panel 12 to the central monitoring station 20. Further, the communication component 520 may be configured to establish a wireless or a wired communication link with the reporting station 80 for purposes of transmitting data (e.g., points list 18, alarm data or the like) from the alarm panel 12 to the reporting station 80, and receiving requests from the reporting station 80.

In some examples, the communication component 520 may be a network interface component (e.g., an Ethernet port, a WIFI radio, a Cellular radio, or the like). In other non-exhaustive, non-limiting examples, the communication component may have universal serial bus (USB), wireless and/or cellular communication ports. Further, the communication component may have plural ports and differing ones of the plural ports may be differing types of ports. For example, there may be three ports, with a first port being an USB port, and second and third ports each being a cellular port. Having plural ports of differing types enables the communication component to facilitate communications with plural apparatus having differing communication capability types, and makes the communication component more versatile.

The memory 530 of the communicator device 70 may store a data/connection monitoring module 540, a protocol converter module 550, a central monitoring station module 560 and a reporting station module 570. The data/connection monitoring module 540 is configured to monitor (see FIG. 1 dashed line 72) for failures in communications between the alarm panel 12 and the central monitoring station 20 along the connection 30. That is, the module may encompass coding (e.g., firmware, software, etc.) configured to provide a set of instructions, which when executed by the processor (and together with other hardware), cause the communicator device 70 to perform a set of data/connection monitoring actions defined by the instructions.

At times, the communicator device 70 may forward alarm data received via monitoring of the connection 30 or received via connection 68 from the alarm panel 12, onward to the central monitoring station 20 and/or the reporting station 80. Data may be received via a first type of protocol, whereas data output by the communicator device 70 may be via a second (differing) type of protocol. For example, data received via monitoring of the connection 30 (e.g. a POTS line) may be analog data, whereas data outputted on the connection 74 (e.g., an Ethernet line) to the central monitoring station 20 may be digital data, or output on the connection 76 (e.g., a cellular channel) to the reporting station 80 may be cellular data. The protocol converter module 550 is configured to provide conversion of data from one protocol to another as needed. That is, the module may encompass coding (e.g., firmware, software, etc.) configured to provide a set of instructions, which when executed by the processor (and together with other hardware), cause the communicator device 70 to perform a set of protocol conversion actions defined by the instructions.

The central monitoring station module 560 is configured to control interfacing and communications with the central monitoring station 20. For example, control if/when to forward data received via monitoring of the connection 30 or received via connection 68 from the alarm panel 12, onward to the central monitoring station 20. For example, control to not forward such data to the central monitoring station 20 when the communicator device 70 is operating in a passive mode, and control to forward such data to the central monitoring station 20 when the communicator device 70 is operating in an active mode. That is, the module may encompass coding (e.g., firmware, software, etc.) configured to provide a set of instructions, which when executed by the processor (and together with other hardware), cause the communicator device 70 to perform a set of decisions, communications, data packaging, etc. actions defined by the instructions.

The reporting station module 570 is configured to control interfacing and communications with the reporting station 80. For example, controls to forward all (safety-type and non-safety type) data received via monitoring of the connection 30 or received via connection 68 from the alarm panel 12, onward to the reporting station 80. By forwarding all data, the decision and processing of which alarm data/incidents to ultimately send on to the subscriber may be delegated to the reporting server 80, thus allowing the communicator to be more generic, compact and less expensive. Such module may encompass coding (e.g., firmware, software, etc.) configured to provide a set of instructions, which when executed by the processor (and together with other hardware), cause the communicator device 70 to perform a set of decision, communications, data packaging, etc. actions defined by the instructions.

Figure 6:
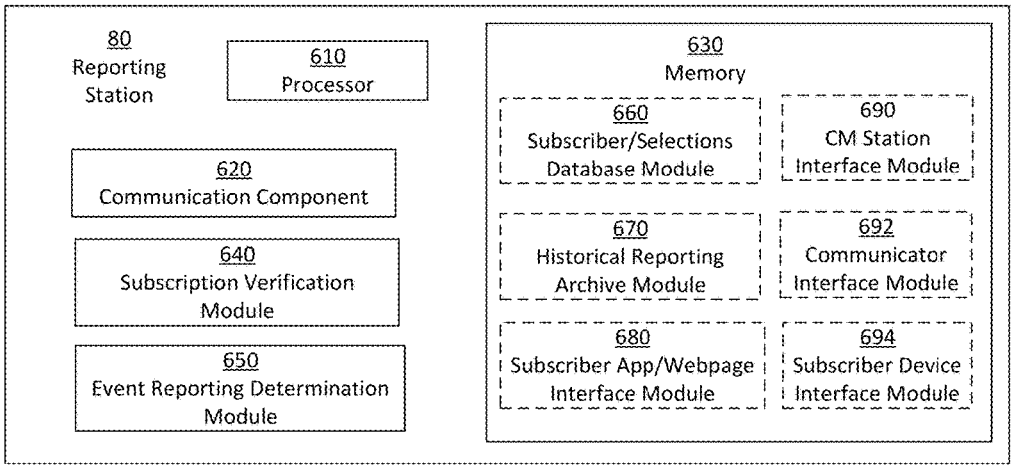

Referring now to FIG. 6, the reporting station 80 includes a processor 610, a communication (e.g., connection) component 620, a memory 630, a subscription verification module 640 and an event reporting determination module 650. The processor 610 can be any microprocessor configured to execute a set of instructions, which when executed, cause the reporting station 80 to perform a set of actions defined by the instructions. The memory 630 may be any type of computer-readable medium, including non-transient computer-readable medium, such as, for example, EPROM, EEPROM, ROM, FLASH, magnetic storage media, or the like.

The communication component 620 may be any device and/or module configured to establish communications with the communicator 70, the central monitoring station 20, and/or the subscriber device 90. In general, the communication component 620 may be configured to establish a wireless or a wired communication link 76 with the communicator 70 for purposes of receiving data output by communicator 70 and/or sending requests to the communicator 70. Additionally, the communication component 620 may be configured to establish a wireless or a wired communication link 78 with the central monitoring station 20 for purposes of exchanging data with the central monitoring station 20. For example, when setting up a new subscriber account, the reporting station 80 may contact the central monitoring station 20 to obtain a copy of the points list 18 to help define selections which the new subscriber may set regarding wanting to be notified about events corresponding to each point 14 in his/her particular alarm system 100. Further, the communication component 620 may be configured to establish a wireless or a wired communication link 82 with a subscriber device 90 (e.g., mobile subscriber device 90) for purposes of transmitting data (e.g., alarm event reports) to the subscriber device, and/or receiving selections, requests, etc. from the subscriber device 90.

In some examples, the communication component 620 may be a network interface component (e.g., an Ethernet port, a WIFI radio, a Cellular radio, or the like). In other non-exhaustive, non-limiting examples, the communication component may have universal serial bus (USB), wireless and/or cellular communication ports. Further, the communication component may have plural ports and differing ones of the plural ports may be differing types of ports. For example, there may be two ports, with a first port being an Ethernet port, and a second port being a cellular port. Having plural ports of differing types enables the communication component to facilitate communications with plural apparatus having differing communication capability types, and makes the communication component more versatile.

The memory 630 of the reporting station 80 may store a subscriber/selections database module 660, a historical reporting archive module 670, a subscriber app/webpage interface module 680, a central monitoring (CM) station interface module 690, a communicator interface module 692 and a subscriber device interface module 694.

The reporting server 80 may provide alarm reporting (e.g, subscription) services to multiple subscribers. Accordingly, the subscriber/selections database module 660 may store a database (e.g., in table form) containing the following non-limiting, non-exhaustive data: subscriber name; subscriber address; subscriber contact information (e.g., telephone number, email address, cellular telephone number, subscriber device IP address), subscription contract information, subscription permissions, password(s), authentication key(s), alarm point selections, subscriber app version, subscriber data protocol, etc. FIG. 10 illustrates one example database 1000 having example columns 1001-1008 and example rows 1051-1063. It is to be understood that FIG. 10's example is non-limiting and non-exhaustive, and that there may be fewer or greater numbers of columns and rows.

The subscriber/selections database module 660 may further encompass coding (e.g., firmware, software, etc.) configured to provide a set of instructions, which when executed by the processor (and together with other hardware), cause the reporting station 80 to assist in authentication of a subscriber submitting an access request and/or to perform a set of subscriber/selection actions defined by the instructions.

The historical reporting archive module 670 may store a historical record of alarm incident reporting and other communications noted for each subscriber. Further, the historical reporting archive module 670 may encompass coding (e.g., firmware, software, etc.) configured to provide a set of instructions, which when executed by the processor (and together with other hardware), cause the reporting station 80 to perform a set of historical archiving actions defined by the instructions.

The subscriber app/webpage interface module 680 may facilitate and control interactions between the subscriber device 90 and the reporting station 80. For example, the subscriber app/webpage interface module 680 may result in presentation of a webpage allowing a subscriber (via an app on his/her computing device) to view his/her account information, and view/change his/her alarm reporting selections. For example, a subscriber "John Doe" might be presented with webpage illustrating the FIG. 10 database rows 1054-1061 pertaining to his account, while not disclosing other rows pertaining to other subscribers' accounts. One example change that a subscriber might while viewing his account would be to correct or update his/her address information.

Also, FIG. 10's column 1006 may list alarm points which are selectable/deselectable by the subscriber, e.g., by designating "Y" (to report events) or "N" (to not report events) in the "Report?" column 1007. As one example, the "John Doe" subscriber may choose to deactivate ("N") a "Kit Motion" (column 1006, row 1054) selection so as not to receive event reporting of a kitchen-situated motion detector (e.g., if the subscriber's dog/cat is causing excessive motion detection reports). Subscriber selections may be dynamic and change over time as the subscriber's preferences change. As another example, a subscriber may choose to activate ("Y") a "Child1 Codein" (column 1006, row 1058) selection so as to receive event reporting of a child's arrival/departure (e.g., to receive reports of when a child codes into the alarm panel when arriving home after school, or when the child departs the home). Such examples are non-limiting, non-exhaustive as there may be hundreds of differing types of non-safety-alarm reports which are available. Further, points installed within differing subscriber alarm systems may vary considerably from one another.

Given that the subscriber can select points reporting which is appropriate to his/her lifestyle, selections may be called "Lifestyle Selections", and the reporting server 80 may be said to be a "Lifestyle Server".

To facilitate operations, the subscriber app/webpage interface module 680 may encompass coding (e.g., firmware, software, etc.) configured to provide a set of instructions, which when executed by the processor (and together with other hardware), cause the reporting station 80 to perform a set of subscriber app/webpage interface actions defined by the instructions.

The central monitoring station interface module 690 is configured to control interfacing and communications with the central monitoring station 20. For example, control connection to, and exchange of data with, the central monitoring station 20. That is, the module may encompass coding (e.g., firmware, software, etc.) configured to provide a set of instructions, which when executed by the processor (and together with other hardware), cause the reporting station 80 to perform a set of connection and exchange actions defined by the instructions.

The communicator interface module 692 is configured to control interfacing and communications with the communicator 70. For example, controls to receive all (safety-type and non-safety type) data incoming from the communicator 70 via connection 76. By receiving all data, the decision and processing of which alarm data/incidents to ultimately send on to the subscriber may be enabled to the reporting server. Such module may encompass coding (e.g., firmware, software, etc.) configured to provide a set of instructions, which when executed by the processor (and together with other hardware), cause the reporting station 80 to perform a set of receipt, processing, etc. actions defined by the instructions.

The subscriber device interface module 694 is configured to control interfacing and communications with the subscriber device 90. For example, controls to: verify authorization/authentication of a subscriber device attempting (e.g., app/webpage) connection to the reporting station 80; allow exchange of data between the reporting station 80 and the subscriber device 90. The subscriber device interface module 694 may further provide protocol conversion services. For example, data received by the reporting station 80 may be via a first type of protocol, whereas data output to the subscriber device 90 may be in a second (differing) type of protocol. For example, data received via connection 76 (e.g., an Ethernet line) may be digital data packaged via an Ethernet protocol, while data output on the connection 82 (e.g., a cellular channel) to the subscriber device 90 may be data packaged via a cellular protocol. Accordingly, the subscriber device interface module 694 may encompass coding (e.g., firmware, software, etc.) configured to provide a set of instructions, which when executed by the processor (and together with other hardware), cause the reporting station 80 to perform a set of authentication verification, data exchange, and protocol conversion actions defined by the instructions.

The subscription verification module 640 is configured to verify or authenticate whether a person submitting an incoming request (e.g., via an incoming telephone call, or subscriber device 90 request, etc.) to the reporting station 80 for access to a subscriber's account, is a subscriber who is authorized to gain access to that account. As one example, the subscription verification module 640 may accomplish verification by comparing authentication information (e.g., a password) provided with the incoming request, to information maintained (see FIG. 10 column 1005) by the subscriber/selections database module 660. As another example, public/private key methodology may be used.

If verified as an authorized subscriber, the person may gain access to the subscriber account to perform any of subscriber allowed actions (e.g., access account information; update account information; change alarm point selections, etc.) For example, if the subscription verification module 640 verified that a "cinnam0n" password submitted by John Doe matched with the "cinnam0n" password in the FIG. 10 database (see column 1005, row 1054), the subscriber app/webpage interface module 680 may then be allowed to operate to present a webpage illustrating the FIG. 10 database rows 1054-1061 pertaining to Doe's account.

The subscription verification module 640 may itself encompass coding (e.g., firmware, software, etc.) configured to provide a set of instructions, which when executed by the processor (and together with other hardware), cause the reporting station 80 to assist in authentication of a person submitting an access request and/or to perform a set of subscriber/selection actions defined by the instructions.

The event reporting determination module 650 is configured to determine which data re alarm events incoming from the communicator 70 should be reported to the subscriber. For example, the subscriber may have designated per his/her selections (FIG. 10 columns 1006-1007), that motion detection via a kitchen situated motion sensor point should not be reported (e.g., if the subscriber's dog/cat (confined to a kitchen area) is causing excessive motion detection reports). Accordingly, data received from the communicator 70 and related to motion detection associated with the kitchen will be ignored, discarded, etc., by the reporting station 80, and will not be reported to the subscriber. As another example, the subscriber may have designated per his/her selections (FIG. 10 columns 1006-1007) to receive child arrival/departure reporting (e.g., to receive reports of when a child arrives home after school, or when the child departs the home). With this example, data received from the communicator 70 and related to child arrival/departure, will be reported to the subscriber. One example data might be the reporting of the child coding-into the alarm panel. The above examples are non-limiting, non-exhaustive as there may be hundreds of differing types of non-safety-alarm reports which may be available and selectable.

To facilitate the above, the event reporting determination module 650 may encompass coding (e.g., firmware, software, etc.) configured to provide a set of instructions, which when executed by the processor (and together with other hardware), cause the reporting station 80 to perform a set of incident reporting decisions and actions defined by the instructions.

Figure 7:
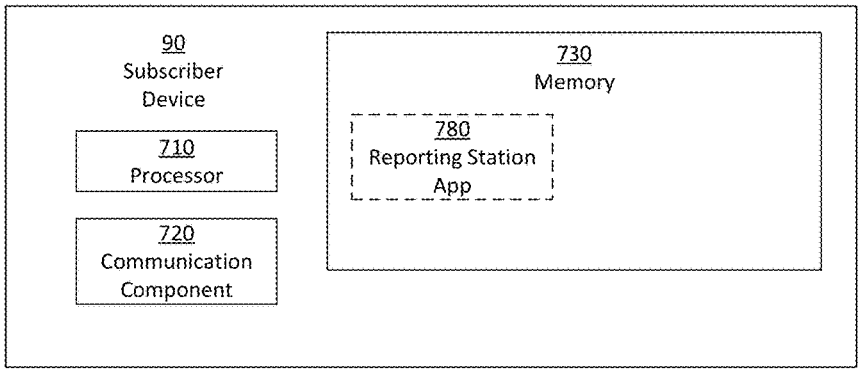

Continuing now with FIG. 7, the subscriber device 90 includes a processor 710, a communication (e.g., connection) component 720 and a memory 730. The processor 710 can be any microprocessor configured to execute a set of instructions, which when executed, cause the subscriber device 90 to perform a set of actions defined by the instructions. The memory 730 may be any type of computer-readable medium, including non-transient computer-readable medium, such as, for example, EPROM, EEPROM, ROM, FLASH, magnetic storage media, or the like. In some instances, the subscriber device 90 may be a desktop, laptop, notebook, tablet computer. In another instance, the subscriber device 90 may be a cell phone (e.g., smart phone). Such are non-limiting, non-exhaustive examples.

The communication component 720 may be any device and/or module configured to establish communications with the reporting station 80. In general, the communication component 720 may be configured to establish a wireless or a wired communication link 82 with the reporting station 80 for purposes of receiving data (e.g., alarm incident reports) output by the reporting station 80 or exchanging data (e.g., account information, reporting selections, etc.) with the reporting station 80.

In some examples, the communication component 720 may be a network interface component (e.g., an Ethernet port, a WIFI radio, a Cellular radio, or the like). In other non-exhaustive, non-limiting examples, the communication component may have wireless and/or cellular communication ports. Further, the communication component may have plural ports and differing ones of the plural ports may be differing types of ports. For example, there may be two ports, with a first port being an Ethernet port, and a second port being a cellular port.

The memory 730 of the subscriber device 90 may store a reporting station app 780 which may control interfacing and communications with the reporting station 80. For example, the reporting station app 780 may provide control to: attempt (e.g., app/webpage) connection to the reporting station 80; receive data (e.g., non-safety-type alarm notifications) from the reporting station 80; and allow exchange of data between the reporting station 80 and the subscriber device 90. The reporting station app 780 may encompass coding (e.g., firmware, software, etc.) configured to provide a set of instructions, which when executed by the processor (and together with other hardware), cause the subscriber device 90 to perform a set of connection, data receipt and data exchange actions defined by the instructions.

Figure 8:
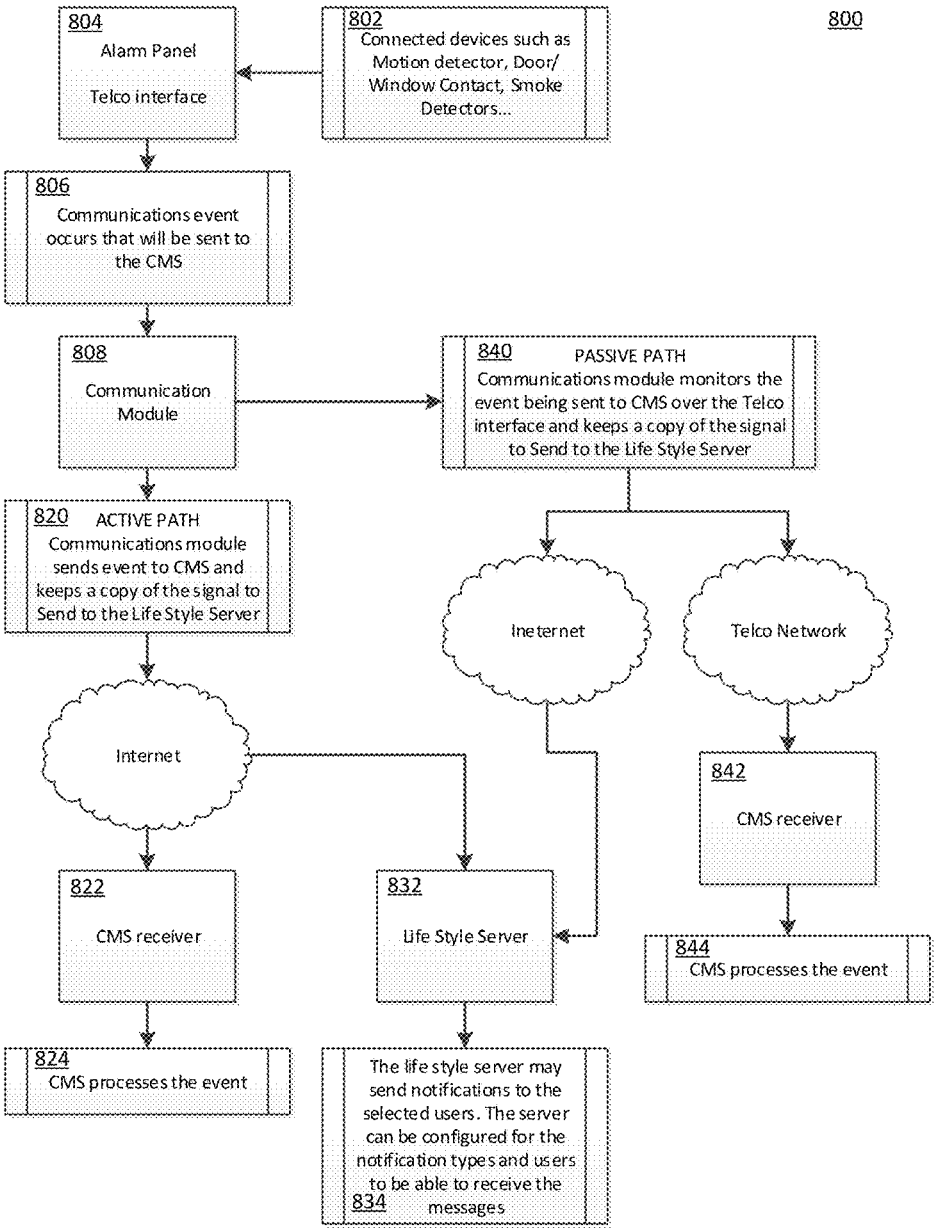
FIGS. 8-9 are flow diagrams illustrating example methods for achieving reporting of non-safety-type alarm events to subscribers, in accordance with the present disclosure.

Next, FIG. 8 illustrates an example flow 800 which may be performed via the alarm system 10 and communicator device 70. More particularly, at block 802, data generated by connected point 14 devices are fed to the alarm panel (block 804). Then, a telephone company ("Telco") interface is used, for example, and alarm events (generated owing to the data) are communicated (block 806) toward the central monitoring station (CMS), for example, on a Telco POTS line. During times when the communicator (block 808) is operating in a passive mode, data travels along the Telco network as a passive path 840, wherein the communicator monitors alarm events being sent to the central monitoring station (CMS) over the telco interface (or network), and keeps a copy of the data to send to the Lifestyle Server 832 (i.e., reporting station) via the Internet, for example. The CMS receives (block 842) the data via the Telco network, and processes 844 the events into alarm notifications. Although not shown, the CMS reports safety-type alarm (e.g., intruder, fire, etc.) notifications to a subscriber.

In contrast, during times when the communicator is operating in an active mode, data travels along an active path (block 820) such as via the Internet, toward the CMS. The CMS receives the data (block 822) via the Internet, and processes (block 824) the events into alarm notifications. Although not shown, the CMS reports safety-type alarm (e.g., intruder, fire, etc.) notifications to a subscriber. Again, the communicator monitors alarm events being sent to the CMS, and keeps a copy of the data to send to the Lifestyle Server (i.e., reporting station) via the Internet, for example (block 832).

Thus, irrespective of whether the communicator is in a passive mode or an active mode, the communicator monitors alarm events originated from the alarm panel and forwards such data onto the Lifestyle Server (block 832). Accordingly, inherent capabilities (e.g., data accessing; data transmission) of the communicator which were unused or idled most of the time (i.e., before this disclosure), are now used to achieve forwarding (and ultimate reporting) of non-safety-type alarm events. That is, non-safety-type alarm events in addition to the safety-type alarm events may be forwarded onto the Lifestyle Server, or alternatively, only non-safety-type alarm events may be forwarded. Likewise, non-safety-type alarm events in addition to the safety-type alarm events may be forwarded onto the CMS. As one example, the communicator may be configurable to send all communicable events to either server. The LifeStyle Server reports non-safety-type alarm (e.g., door opened, high temperature level, etc.) notifications to a subscriber (block 834). The Lifestyle Server can be configured (block 834) for designation of notification types to be sent to each subscriber, and for designation of which subscribers (e.g., wife as primary subscriber, and husband as secondary subscriber) are to receive the notifications.

To summarize a difference between the central monitoring station and the reporting station of arrangements of the invention, alarm events reported by the central monitoring station are those which are designated as reportable events by the alarm monitoring company (e.g., by an alarm monitoring contract). In contrast, alarm events reported by the reporting station are those which are designated as reportable events by the subscriber (e.g., via selection on the subscriber's account webpage).

In another embodiment, the alarm panel 12 or communicator 70 may include a programmable library of recipients (e.g., telephone numbers) together with a programmable listing of types of alarm events which should be send to each recipient. Such may be called "call directions". As one example, the library may include a central monitoring station's maintenance department telephone number as one recipient, and the listing may instruct that any maintenance-related alarm events (e.g., low battery, impending expiration date, etc.) be call directed to the maintenance department telephone number. As another example, the listing may instruct that any "contact open/close" alarm events (e.g., front door contact switch opened or closed) be directed to the central monitoring station's monitoring department telephone number. The library and listing arrangement may be further leveraged to also program which types of alarm events should be sent to the reporting server 80. More particularly, assume that default programming is configured to send maintenance-related alarm events only to the maintenance department telephone number, and to send "contact open/close" alarm events only to the monitoring department telephone number. If a resident having an alarm system installed (or upgraded) subscribes to reporting services of the reporting server 80, the library of recipients may be further programmed with a telephone number of the reporting server 80. Further, if polling of the resident at a time of alarm installation/setup indicates that the resident desires to be notified (via the reporting server 80) of any maintenance-related alarm events, then the listing may be further programmed to send the maintenance-related alarm events to the reporting server 80 telephone number in addition to sending to the maintenance department telephone number. Further, if polling of the resident indicates that the resident desires to be notified of any "contact open/close" alarm events (e.g., so they can monitor the arrival at home of school-aged children), then the listing may be further programmed to send any "contact open/close" alarm events to the reporting server 80 telephone number in addition to sending to the monitoring department telephone number.

The foregoing illustrative examples are given for purposes of completeness and clarity, but are not intended to be limiting. It is to be appreciated, that a variety of different example implementations of the above described systems and methods may exist. These various examples may depend upon the particular alarm system, the monitoring service, the operator, the alarm system, or other conditions and standards. As such, other implementations and examples not disclosed herein are possible without departing from the sprit and scope of the claimed subject matter.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

The various embodiments or components described above, for example, the alarm panel, the central monitoring station, the computing device, the communicator, the reporting station, the subscriber device, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system. As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. An alarm system communicator comprising:

a central monitoring station (CMS) communications module to forward alarm event data monitored from a first communications path, to a remote CMS over a second communications path while the alarm system communicator is operable in an active mode, and not to forward the alarm event data to the remote CMS while operable in a passive mode; and a secondary monitoring station (SMS) communications module to forward at least a portion of the alarm event data to a SMS, at least while the CMS communications module is in the passive mode.

2. The alarm system communicator as claimed in claim 1, wherein:

the SMS communications module is configured to forward all the alarm event data to the SMS, at least while the CMS communications module is in the passive mode.

3. The alarm system communicator as claimed in claim 1, wherein:

the SMS communications module is configured to forward at least a portion of the alarm event data to the SMS, irrespective of whether the alarm system communicator is in the active mode or the passive mode.

4. The alarm system communicator as claimed in claim 1, wherein:

the SMS communications module is configured to forward all the alarm event data to the SMS, irrespective of whether the CMS communications module is in the active mode or the passive mode.

5. The alarm system communicator as claimed in claim 1, wherein:

the SMS communications module processes the alarm events data received via a first communications protocol, into processed communications having the alarm events data via a differing second communications protocol, to forward the processed communications to the SMS.

6. The alarm system communicator as claimed in claim 1, wherein the alarm system communicator is configured to be operable in the passive mode during times when the communications output from an alarm panel are successfully delivered to the remote CMS via the first communications path, and is configured to be operable in the active mode during times when the communications are unsuccessfully delivered to the remote CMS via the second communications path.

7. The alarm system communicator as claimed in claim 1, wherein the alarm event data over time include both predetermined safety-type and non-safety-type alarm event data, and wherein the SMS communications module is configured to forward only the non-safety-type alarm event data to the SMS.

8. A method implemented in an alarm system communicator, comprising:

monitoring alarm event data of communications output from an alarm panel to a communications path, irrespective of whether the alarm system communicator is in an active mode or a passive mode;

forwarding the alarm event data to a remote central monitoring station (CMS) over another communications path while the alarm system communicator is operable in the active mode, and not forwarding the alarm event data to the remote CMS while operable in a passive mode; and forwarding at least a portion of the alarm event data to a secondary monitoring station (SMS), at least while the CMS communications module is in the passive mode.

9. The method as claimed in claim 8, comprising:

forwarding all the alarm event data to the SMS, at least while the CMS communications module is in the passive mode.

10. The method as claimed in claim 8, comprising:

forwarding at least a portion of the alarm event data to the SMS, irrespective of whether the alarm system communicator is in the active mode or the passive mode.

11. The method as claimed in claim 8, comprising:

processing the alarm events data received via a first communications protocol, into processed communications having the alarm events data via a differing second communications protocol, and forwarding the processed communications to the SMS.

12. The method as claimed in claim 8, wherein the alarm system communicator is configured to be operable in the passive mode during times when the communications output from the alarm panel are successfully delivered to the remote CMS via the communications path, and is configured to be operable in the active mode during times when the communications are unsuccessfully delivered to the remote CMS via the communications path.

13. The method as claimed in claim 8, wherein the alarm event data over time include both predetermined safety-type and non-safety-type alarm event data, and wherein only the non-safety-type alarm event data is forwarded to the SMS.

14. An alarm system comprising:

an alarm system communicator including:

a central monitoring station (CMS) communications module to forward alarm event data monitored from a first communications path, to a remote CMS over a second communications path while the alarm system communicator is operable in an active mode, and not to forward the alarm event data to the remote CMS while operable in a passive mode; and a secondary monitoring station (SMS) communications module to forward at least a portion of the alarm event data to a SMS, at least while the CMS communications module is in the passive mode; and the SMS to receive the at least a portion of the alarm event data, and configured to report at least one non-safety-type alarm notification derived from the at least a portion of the alarm event data.

15. The alarm system as claimed in claim 14, wherein:

the SMS communications module is configured to forward all the alarm event data to the SMS, at least while the CMS communications module is in the passive mode.

16. The alarm system as claimed in claim 14, wherein:

the SMS communications module is configured to forward at least a portion of the alarm event data to the SMS, irrespective of whether the alarm system communicator is in the active mode or the passive mode.

17. The alarm system as claimed in claim 14, wherein:

the SMS communications module is configured to forward all the alarm event data to the SMS, irrespective of whether the CMS communications module is in the active mode or the passive mode.

18. The alarm system as claimed in claim 14, wherein:

the SMS communications module processes the alarm events data received via a first communications protocol, into processed communications having the alarm events data via a differing second communications protocol, to forward the processed communications to the SMS.

19. The alarm system as claimed in claim 14, wherein the alarm system communicator is configured to be operable in the passive mode during times when the communications output from the alarm panel are successfully delivered to the remote CMS via the communications path, and is configured to be operable in the active mode during times when the communications are unsuccessfully delivered to the remote CMS via the communications path.

20. The alarm system as claimed in claim 14, wherein the alarm event data over time include both predetermined safety-type and non-safety-type alarm event data, and wherein the SMS communications module is configured to forward only the non-safety-type alarm event data to the SMS.

21. An alarm system comprising:

an alarm system communicator including:

a central monitoring station (CMS) communications module to forward alarm event data monitored from a communications path, to a remote CMS over another communications path while the alarm system communicator is operable in an active mode, and not to forward the alarm event data to the remote CMS while operable in a passive mode; and a secondary monitoring station (SMS) communications module to forward at least a portion of the alarm event data to a SMS, at least while the CMS communications module is in the passive mode; and the SMS to receive the at least a portion of the alarm event data, and configured to report at least one non-safety-type alarm notification derived from the at least a portion of the alarm event data to a subscriber of the SMS, where the at least one non-safety-type alarm notification is subscriber-designated and is different from CMS-designated alarm notifications reportable by the remote CMS.

* * * * *